United States Patent [19]

Kato

[11] Patent Number: 4,532,453

[45] Date of Patent: Jul. 30, 1985

[54] STORAGE TARGET FOR STORAGE TUBES AND METHOD OF FABRICATION

[75] Inventor: Takefumi Kato, Hinode, Japan

[73] Assignee: Iwatsu Electric Co., Ltd., Tokyo, Japan

[21] Appl. No.: 553,483

[22] Filed: Nov. 18, 1983

[30] Foreign Application Priority Data

Dec. 3, 1982 [JP] Japan ..... 57-212374

[51] Int. Cl.[3] ..... H01J 29/41

[52] U.S. Cl. ..... 313/391; 313/392; 313/395; 313/397; 357/60; 357/61; 445/30; 445/36; 445/37; 445/47

[58] Field of Search ..... 313/391, 392, 394, 395, 313/397; 357/55, 60, 61; 445/30, 36, 37, 47

[56] References Cited

U.S. PATENT DOCUMENTS

| | | | |
|---|---|---|---|
| 3,877,060 | 4/1975 | Shono et al. | 357/55 X |
| 4,215,288 | 7/1980 | Kato et al. | 313/394 |
| 4,262,230 | 4/1981 | Kato et al. | 313/395 |
| 4,288,720 | 9/1981 | Kato et al. | 315/13 ST |
| 4,389,591 | 6/1983 | Uno | 313/395 X |
| 4,407,934 | 10/1983 | Kuchinsky et al. | 445/37 X |

FOREIGN PATENT DOCUMENTS

| | | | |
|---|---|---|---|
| 0140459 | 10/1979 | Japan | 445/47 |

*Primary Examiner*—Arthur Kellogg

*Attorney, Agent, or Firm*—Woodcock, Washburn, Kurtz, Mackiewicz & Norris

[57] ABSTRACT

A storage target is disclosed for use in a scan converter storage tube, direct view storage tube, etc. Included are a storage substrate in the form of a single crystal of sapphire, and a collector electrode in the shape of a directional pattern on a storage surface of the storage substrate. In order to afford a high writing speed the directional pattern of the collector electrode is oriented at an angle ranging from −45 degrees to +45 degrees with respect to the projection of the c axis of the single sapphire crystal on the storage surface of the substrate. The collector electrode is preferably in the form of electrically interconnected parallel stripes extending in the direction of the projected c axis.

9 Claims, 13 Drawing Figures

STORAGE TARGET FOR STORAGE TUBES AND METHOD OF FABRICATION

BACKGROUND OF THE INVENTION

This invention relates to storage tubes for the storage and subsequent extraction of information and, more specifically, to improvements in a storage tube target of the type described and claimed in Kato et al. U.S. Pat. No. 4,215,288 entitled "Storage Target for Scan Converter Tubes" and dated July 29, 1980. The invention also specifically pertains to a method of fabricating the improved storage target.

In addition to the above referenced patent the following patents have particular pertinence to the instant application: (1) Kato et al. U.S. Pat. No. 4,288,720 entitled "Method for Erasing Information in a Scan Converter Storage Tube" and dated Sept. 8, 1981; and (2) Kato et al. U.S. Pat. No. 4,262,230 entitled "Storage Target for Direct View Storage Tubes" and dated Apr. 14, 1981.

The first recited U.S. Pat. No. 4,215,288 proposes the use of a single crystal of sapphire (aluminum oxide, $Al_2O_3$) for the storage layer or substrate of a storage target. The storage substrate has a collector electrode formed on its storage surface. The collector electrode is a very thin metal sheet or film of striped or latticed pattern, defining a plurality or multiplicity of openings to expose parts of the storage surface of the substrate. The second mentioned U.S. Pat. No. 4,288,720 teaches a method of erasing information from this type of storage target as used in a scan converter storage tube. The third mentioned U.S. Pat. No. 4,262,230 suggests an adaptation of the storage target for direct view storage tubes.

The prior art storage target with the monocrystalline sapphire substrate makes possible the introduction (writing) of information into the storage tube at high speed. For a still higher writing speed desired today, however, the storage target as heretofore constructed has necessitated an increase in the potential of the collector electrode.

The increase in the collector electrode potential is undesirable for more reasons than one. First, the device must be made capable of withstanding high voltages, thereby inevitably becoming bulky and expensive. Moreover, with the increase in the collector electrode potential for the writing mode, the difference becomes correspondingly greater between this and the collector electrode potential for the reading (extraction of the stored information) or erasing mode. This great difference requires expensive circuitry for setting the collector electrode at the required potential at the time of each transition from one operating mode to another.

The same problem has been encountered with the direct view storage tubes incorporating the storage target with the monocrystalline sapphire substrate described and claimed in the aforesaid U.S. Pat. No. 4,262,230. The objective of high speed writing should therefore be accomplished without an accompanying increase in collector potential.

The noted U.S. Pat. No. 4,215,288 refers to the relationship between the writing speed and the crystallographic orientation of the collector bearing surface of the monocrystalline sapphire substrate. Later study has proved, however, that what is more important for a higher writing speed is the relationship between the crystal axis of the storage substrate and the directionality of the pattern of the collector electrode thereon.

By the term "directionality" is meant the property of the specific pattern of the collector electrode being generally oriented in a particular direction. The collector electrode is more directional if it is in the form of parallel stripes than in the form of a lattice. The directionality of the parallel stripes is tantamount to the direction in which they extend.

SUMMARY OF THE INVENTION

The present invention is based upon the discovery that in storage targets of the type in question, the relationship between the crystal axis of the storage substrate and the directionality of the collector electrode thereon markedly affects the writing speed. By taking advantage of this discovery the invention provides a solution to the problem of how to increase the writing speed of the storage tubes of the class defined, without an increase in the potential of the collector electrode.

Stated briefly in one aspect thereof, the invention concerns an improved storage target for use in scan converter storage tubes, direct view storage tubes, etc., comprising a storage substrate fabricated from a single crystal of sapphire, and a collector electrode of a more or less directional pattern formed on one surface of the storage substrate. The directional collector electrode pattern is oriented at an angle ranging from about −45 degrees to about −45 degrees with respect to the projection of the c axis of the single sapphire crystal on the surface of the storage substrate bearing the collector electrode thereon.

In a preferred embodiment the collector electrode takes the form of parallel spaced stripes extending in the direction of the projected c axis, that is, with a zero angle therebetween. This orientation of the collector electrode has proved to afford maximum speed writing.

Another aspect of the invention relates to a method of fabricating the storage target of the above improved construction. Prior to the creation of the collector electrode thereon, the storage substrate is marked to indicate the direction of the projection of the c axis of the single sapphire crystal of which the substrate is made, on its surface which is to bear the collector electrode thereon. The collector electrode is subsequently formed on this surface of the storage substrate in any suitable manner with its directionality oriented in the above specified range of angles with respect to the direction of the projected c axis indicated by the marking.

The marking of the storage substrate makes it possible to produce the collector electrode thereon, as by vacuum deposition or sputtering followed by etching, with its directional pattern oriented in the exact direction desired (e.g. the direction of the projected c axis). This is essential for the quantity production of storage targets that enable writing at invariably high speed.

The above and other features and advantages of this invention and the manner of realizing them will become more apparent, and the invention itself will best be understood, from a study of the following description and appended claims, with reference has to the attached drawings showing some preferable embodiments of the invention.

DESCRIPTION OF THE PREFERRED EMBODIMENTS

Figure 1:
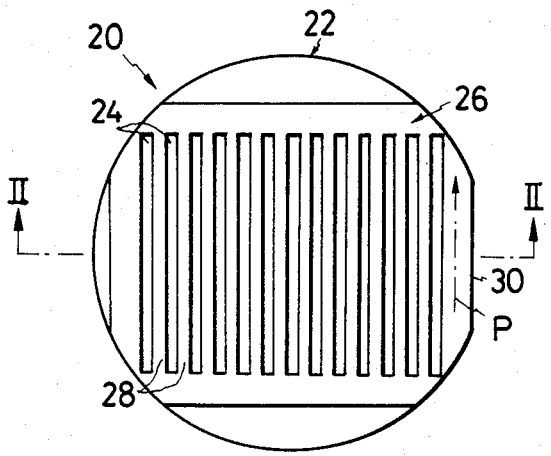
FIG. 1 is a plan of a preferable form of the storage target embodying the novel concepts of this invention.

The invention will now be described more specifically in terms of a first preferable embodiment thereof shown in FIGS. 1 and 2. Generally designated 20, the illustrated representative storage target in accordance with the invention comprises a storage substrate 22 in the form of a thin monocrystalline disk of sapphire having a storage surface 24, and a collector electrode 26 of a directional pattern covering the effective (approximately rectangular) region of the storage surface 24. The collector electrode 26 is shown to comprise a plurality of parallel spaced stripes 28 each having a width of about one to 50 microns and having constant spacings of about five to 50 microns.

In appearance the storage target 20 of the above configuration is akin to one of the exemplified forms of the storage target described and claimed in the aforementioned Kato et al. U.S. Pat. No. 4,215,288, only with the exception that the storage target 20 has a recess 30 defined chordally in its storage substrate 22 to mark the direction of the projection P of the c axis of the single sapphire crystal on the storage surface 24 of the substrate.

The present invention features the specific orientation of the directionally patterned collector electrode 26 with respect to the projected c axis P. In this particular embodiment the orientation of the collector electrode 26 agrees with the direction of the projected c axis P as indicated by the chordal recess of marking 30 in the storage substrate 22.

In accordance with another feature of the invention the collector bearing storage surface 24 of the storage substrate 22 is, for the best results, an r-plane ($1\bar{1}02$) of the single crystal of sapphire of which it is made. The projection P of the c axis of the single crystal on its r-plane is yet to be discussed.

The striped collector electrode 26 may be fabricated, for example, by the vacuum deposition or sputtering of chromium on the storage surface 24 of the storage substrate 22 to a thickness of from about 0.05 microns to the order of several microns. Then an etchant resist mask may be laid over the chromium film. The etchant resist mask has of course the exact shape of the collector electrode 26 to be left unetched on the storage substrate 22. In placing this mask on the storage substrate its stripes should be laid parallel to the chordal recess 30 in the substrate. Then, by etching away the exposed portions of the chromium film, there can be obtained the collector electrode 26 with its stripes 28 oriented in the direction of the projected c axis P. The spacings between the stripes 28 of the collector electrode 26, through which are exposed the storage surface 24, should preferably be less than the diameter of the electron beam to fall thereon. Thus, if the beam diameter is 50 microns, for instance, then the stripe spacings may be 24 microns or so.

Figure 3:
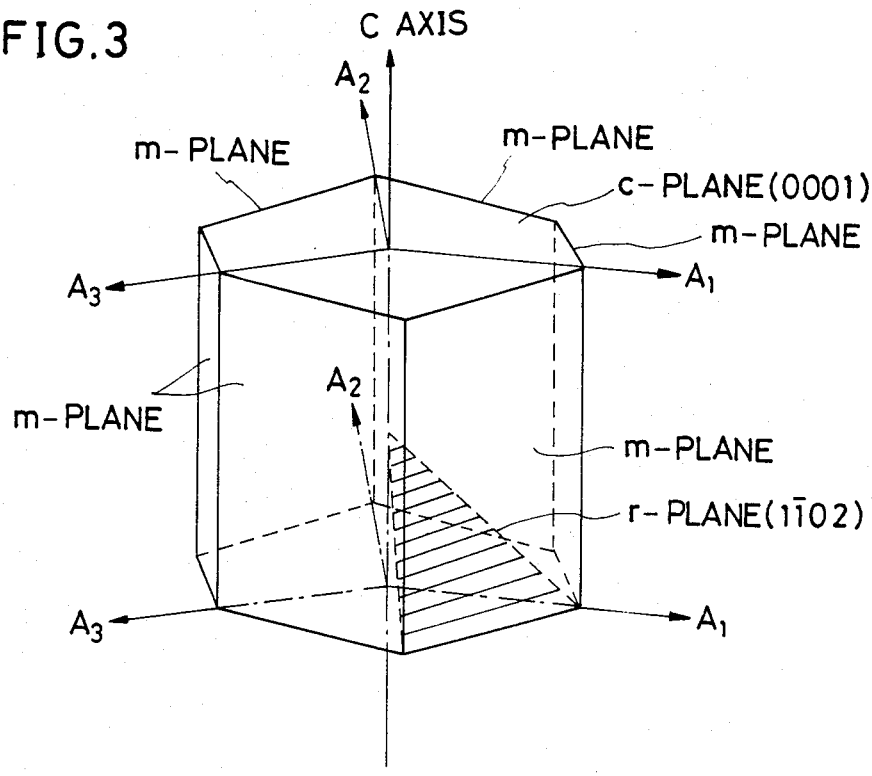
FIG. 3 is a three dimensional representation of a single crystal of sapphire from which there can be made the storage substrate of the storage target of FIGS. 1 and 2.

FIG. 3 is a three dimensional representation of the syngle crystal of sapphire from which there can be made the substrate 22 of the storage target 20 in accordance with the invention. The figure particularly depicts the principal c axis of the sapphire crystal in relation to its c-, m- and r-planes. The illustrated embodiment takes the r-plane of the sapphire crystal at the storage surface 24 of the substrate 22. The reference characters A1, A2 and A3 in FIG. 3 denote the three crystallographic axes of the sapphire crystal, all passing through the c axis and angularly spaced 120 degrees from one another.

Figure 4:
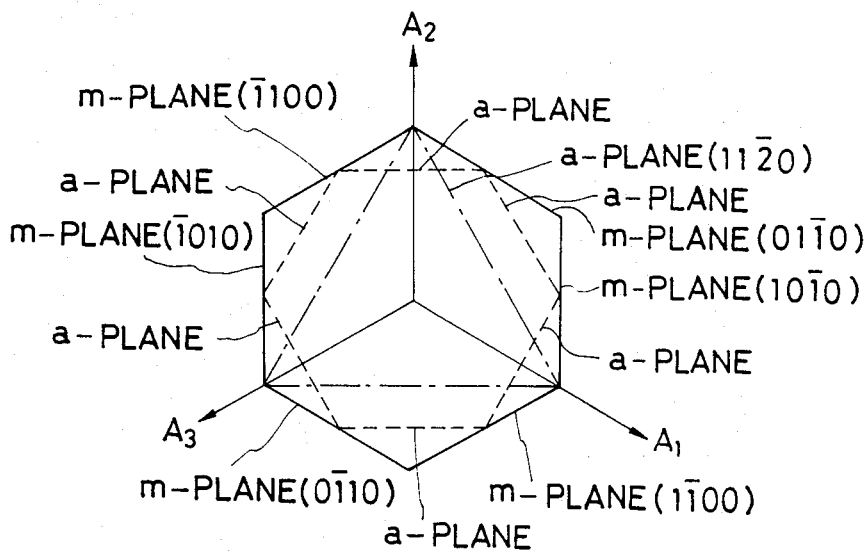
FIG. 4 is a two dimensional representation of the single sapphire crystal of FIG. 3.

FIG. 4 is a planar representation of the same sapphire crystal, particularly depicting the relationship between its a- and m-planes. The c axis of the crystal extends perpendicular to the sheet of this drawing, passing the crossing point of the three crystallographic axes A1, A2 and A3.

Figure 5:
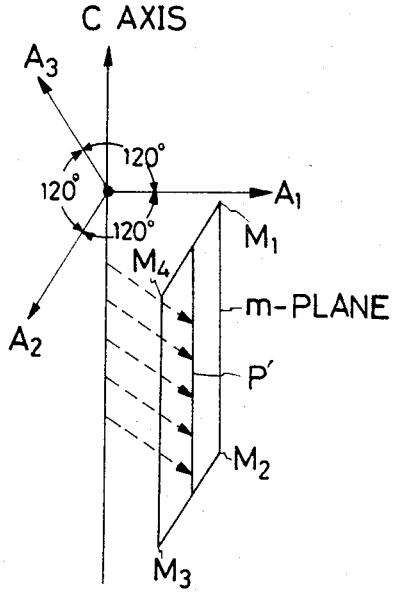
FIG. 5 is a diagram explanatory of a projection of the c axis of the single sapphire crystal of FIGS. 3 and 4.

By the "projected c axis" P of FIG. 1 is meant the projection of the c axis of FIG. 3 on a desired crystal plane. In this embodiment the storage surface 24 of the storage target 20 is the r-plane, as has been stated. However, the way the c axis is projected on the r-plane is too difficult to illustrate and too complex to explain without illustration. FIG. 5 is drawn to explain, instead, the projection of the c axis on an m-plane.

In FIG. 5 the noted three crystallographic axes A1, A2 and A3 diverge apart from a common point in coplanar relation to one another and at angular spacings of 120 degrees. The c axis passes through the common point at right angles with the plane of the crystallographic axes. This c axis is projected on the m-plane, shown bounded by the solid lines passing points M1, M2, M3 and M4, as indicated by the dashed lines. The projected c axis on the m-plane is designated P'. For thus projecting the c axis the dashed lines extend right angularly therefrom and fall on the closest points on the m-plane. The projections of the c axis on the other planes, r, a, etc., are determined similarly.

Figure 6:
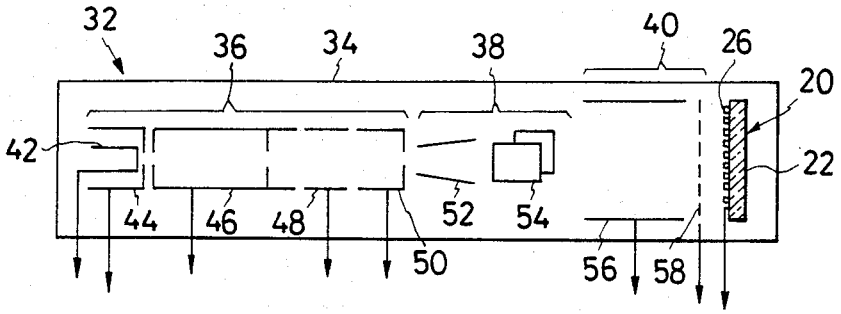
FIG. 6 is a diagrammatic longitudinal section through a scan converter tube incorporating the storage target of FIGS. 1 and 2.

FIG. 6 diagrammatically illustrates an example of scan converter storage tube, generally labelled 32, into which there can be incorporated the storage target 20 of the above improved construction. The storage tube 32 has a hermetically sealed, tubular vacuum envelope 34 housing the storage target 20 adjacent one axial end thereof. Disposed adjacent the other axial end of the vacuum envelope 34 is an electron gun 36 for emitting a modulatable electron beam directed toward the storage target 20. The vacuum envelope 34 further accommodates a deflection system 38 and a collimation system 40, which are arranged one after the other along the path of the electron beam from gun 36 to target 20.

The electron gun 36 comprises a cathode 42, a control grid 44, an acceleration electrode 46, a focusing electrode 48, and an astigmatizer electrode 50. The deflection system 38 comprises a pair of vertical deflection plates 52 and a pair of horizontal deflection plates 54 for deflecting the electron beam from the gun 36 vertically and horizontally, respectively. The collimation system 40 comprises a wall electrode 56 and a field mesh electrode 58.

All the components set forth in the preceding paragraph are arranged in that order along the axis of the vacuum envelope 34, in the direction from gun 36 toward target 20. The storage target 20 is disposed with the stripes of its collector electrode 26 oriented in the direction of horizontal scanning by the electron beam.

The cathode 42 of the electron gun 36 may be set at −900 V, and its acceleration electrode 46 at 1 kV with respect to the cathode potential (assumed to be zero). The wall electrode 56 of the collimation system 40 may be held at 1 kV, and its field mesh electrode 58 at 2.3 kV, both with respect to the cathode potential. The potential of the collector electrode 26 of the storage target 20 with respect to the cathode potential may be 15 V during reading and, during writing, may range from one to 10 kV depending upon the frequency band of the input signal.

The scan converter storage tube 32 of the foregoing construction, using the storage target 20 of FIGS. 1 and 2, offers a writing speed of as high as 6500 divisions per microsecond, one division being 1.2 millimeter, as has been ascertained by experiment set forth subsequently. The signals to be written may range in frequency from zero (direct current) to several million megahertz.

Figure 7:
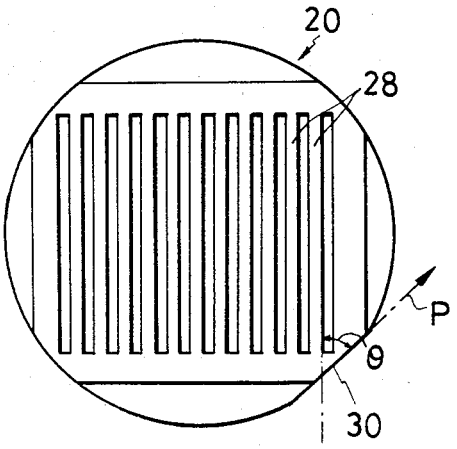
FIG. 7 a view similar to FIG. 1 except that the collector electrode is oriented at an arbitrary angle to the projected c axis on the collector bearing surface of the storage substrate in order to ascertain the relationship between this angle and the writing speed.
Figure 8:
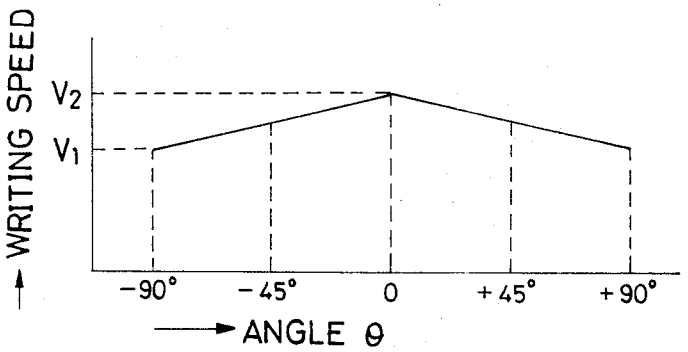
FIG. 8 is a graph plotting the writing speed against the angle between the orientation of the collector electrode and the projected c axis on the collector bearing surface of the storage substrate.

It has been stated in conjunction with FIG. 1 that in the storage target 20 illustrated therein, the stripes 28 of the collector electrode 26 are oriented in the direction of the projected c axis P as indicated by the chordal recess 30 in the storage substrate 22. Experiment has proved that the angle between collector stripes 28 and projected c axis P has a definite relation to the rate at which information can be written on the storage target. For that experiment a number of test storage targets were prepared which were all constructed as in FIGS. 1 and 2 except that the angle $\theta$, FIG. 7, between collector stripes 28 and chordal recess 30 (projected c axis P) was varied from one test piece to another. The writing speed afforded by the test storage targets were measured under the same conditions of beam intensity, target voltage, etc. FIG. 8 graphically represents the results.

It will be observed from this graph that the writing speed varies in direct proportion with the angle $\theta$, even though all the test targets are of the same materials and of the same configuration except for that angle. The writing speed falls to a minimum (V1=5000 division/microsecond) when the angle $\theta$ is plus or minus 90 degrees, and rises to a maximum (V2=6500 division/microsecond) when the angle is zero. Thus the collector electrode 26 should be oriented in the exact direction of the projected c axis P for the maximum writing speed, as in the storage target 20 of FIGS. 1 and 2. Taken in the broader aspect of the invention, however, the angle $\theta$ can be anywhere between minus 45 degrees and plus 45 degrees. For, at plus or minus 45 degrees, the writing speed is approximately 5750 divisions per microsecond, appreciably higher than the above stated value when the angle is plus or minus 90 degrees.

The reason why the writing speed increases with a decrease in the angle $\theta$ is not necessarily clear. A possible reason may be that with the decrease in the angle $\theta$, the holes and electrons generated upon electron beam bombardment become more mobile, resulting in their greater drift distances and, therefore, in the higher efficiency with which the collector electrode captures the electrons.

With the writing speed increased as above by the improved construction itself of the storage target in accordance with the invention, it becomes unnecessary to increase the potential of the collector electrode to realize the high writing speed. Also, in order to obtain the same writing speed as that of the prior art, the collector potential can be made lower than heretofore, affording relative improvement in the voltage withstanding ability of the device. The reduction of the collector potential for the write mode is desirable in view of the smaller voltage changes at the time of transitions between the erase (prewrite), write, and read modes.

Little or no fluctuations in writing speed should be allowed in the mass production of the storage tubes or storage targets taught by this invention. Since the writing speed depends upon the angle between the general orientation of the collector electrode and the projected c axis on the storage substrate, the collector electrode of each storage target must be oriented in the same direction relative to the projected c axis for the above purpose. Thus the invention proposes the chordal recess 30 in, or any other suitable marking on, each storage substrate 22 to indicate the direction of the projected c axis thereon. Such a marking makes it possible to fabricate collector electrodes in the same direction on respective storage substrates, for the provision of storage tubes offering an invariably high writing speed.

Second Form

Figure 9:
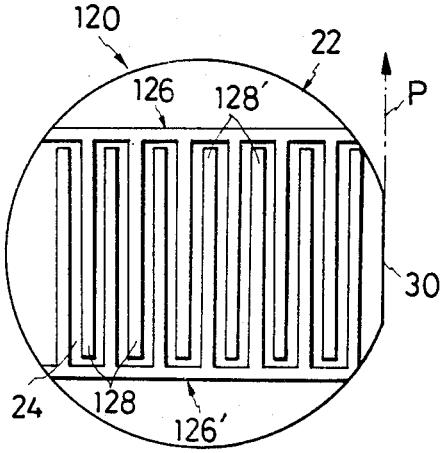
FIG. 9 is a plan of another preferable form of the storage target in accordance with the invention.

FIG. 9 shows another preferable form of the storage target in accordance with the invention. The modified storage target 120 has a pair of collector electrodes 126 and 126' on the storage surface 24 of the disklike storage substrate 22. The collector electrodes 126 and 126' are each comblike in shape, having groups of parallel spaced stripes 128 and 128' in staggered arrangement overlying the effective area of the storage surface 24. The two staggered groups of stripes 128 and 128' are of the course suitably spaced from one another to expost parts of the effective area of the storage surface 24 of the substrate 22.

Figure 2:
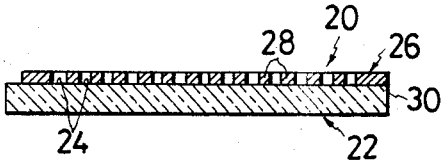
FIG. 2 is a section through the storage target of FIG. 1, taken along the line II—II therein.

As in the FIGS. 1 and 2 embodiment the storage surface 24 of the substrate 22 is, preferably, the r-plane of the single sapphire crystal of which the substrate is made. The chordal recess 30 is cut in this substrate by way of a marking indicative of the direction of the projected c axis thereon. The two staggered groups of collector stripes 128 and 128' both extend in the direction of the projected c axis.

As the two collector electrodes 126 and 126' are electrically disconnected from each other, different voltages are to be applied thereto for writing information in the storage tube incorporating the storage target 120. The different voltages produce an electric field between the two collector electrodes for the higher drift velocity of the hole-electron couples generated upon bombardment of the target by the writing electron beam. The collector electrodes can then capture the electrodes more efficiently and so allow writing at a still higher rate.

Third Form

Figure 10:
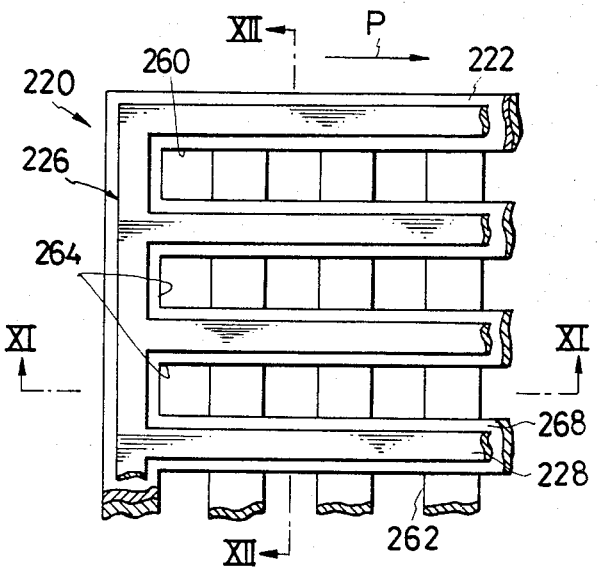
FIG. 10 is a fragmentary plan of still another preferable form of the storage target in accordance with the invention, the storage target being here shown adapted for use in a direct view storage tube.
Figure 12:
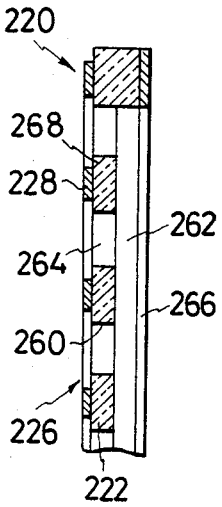
FIG. 12 is also a section through the storage target of FIG. 10, taken along the line XII—XII therein.
Figure 11:
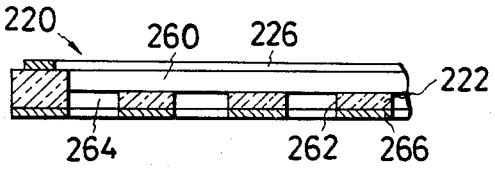
FIG. 11 is a section through the storage target of FIG. 10, taken along the line XI—XI therein.

The principles of this invention are applicable to the storage targets of direct view storage tubes. FIGS. 10 through 12 show one such storage target 220 embodying the concepts of the invention and intended for use in the direct view storage tube of the type illustrated in FIG. 13. This type of storage target, and the direct view storage tube incorporating the same, are both disclosed in the aforementioned Kato et al. U.S. Pat. No. 4,262,230.

The storage target 220 includes a monocrystalline sapphire storage substrate 222 having a first group of parallel spaced grooves 260 defined in its surface to be directed toward the electron gun of the direct view storage tube. A second group of parallel spaced grooves 262 are defined in the opposite surface of the storage substrate 222, to be directed toward the screen, and in right angular relation to the first group of grooves 260. The thickness of the first 222 and second 262 groups of grooves are such that they serve to provide in combination an array of openings 264 ar their intersections. A collector electrode 226 is formed on the gun side surface of the storage substrate 222, and a backing electrode 266 on the screen side surface thereof. The collector electrode 226 has a group of electrically interconnected stripes 228 formed on and extending along respective lands 268 between the first group of grooves 260.

The storage substrate 222 is of course taken along the r-plane of a single sapphire crystal. The stripes 228 of the collector electrode 226 in the direction of the projected c axis P of the single sapphire crystal on the r-plane.

Figure 13:
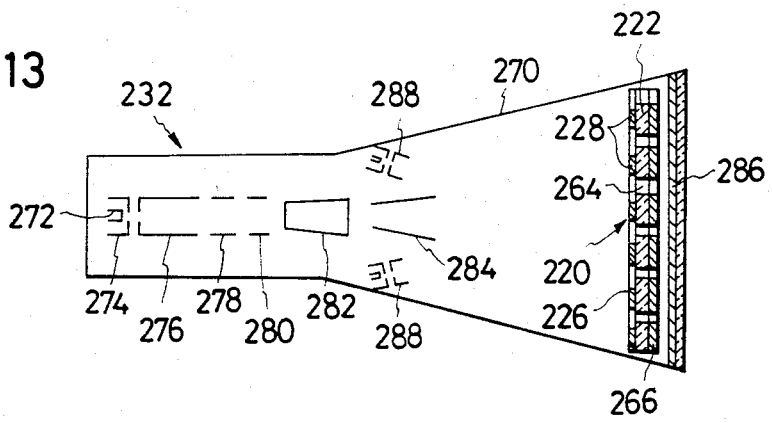
FIG. 13 is a diagrammatic longitudinal section through a direct view storage tube incorporating the storage target of FIG. 10.

The storage target 220 of the above improved construction finds use in the direct view storage tube of FIG. 13. Generally labelled 232, the storage tube has a vacuum envelope 270. Arranged sequentially within the vacuum envelope 270 are a cathode 272, first grid 274, second grid 276, first anode 278, second anode 280, vertical deflector plates 282, horizontal deflector plates 284, storage target 220, and phosphor screen 286. A pair of flood guns 288 are further provided within the vacuum envelope 270 for use in the read and erase modes. Disposed just behind the screen 286, the storage target 220 has its collector electrode 226 directed toward the electron gun, with the collector stripes 228 oriented horizontally (i.e. the direction in which the beam is deflected by the horizontal deflector plates 284).

In the operation of the direct view storage tube 232 the writing electron beam impinges upon the exposed storage surfaces of the storage substrate 222 in a well known manner. In the read mode the electrons selectively pass through the array of openings 264 in the storage target 220 in accordance with the information stored therein.

The storage target 220 in the direct view storage tube 232 offers the same advantages as those set forth in connection with the storage target 20 of FIGS. 1 and 2. Reference is directed to the U.S. Pat. No. 4,262,230 for further structural and operational details of the direct view storage tube.

Possible Modifications

It is to be understood that the present invention is not to be restricted by the exact showing of the accompanying drawings or the description thereof, since numerous changes or modifications will readily occur to one skilled in the art on the basis of this disclosure. The following is a brief list of such possible modifications:

1. The storage surface of the storage substrate may not necessarily be the r-plane of a single crystal of sapphire but may also be any plane (e.g. a, m, etc.) other than the c-plane.
2. The chordal recess or equivalent marking in or on the storage substrate may not necessarily extend in the direction of the projected c axis thereon but may simply bear a definite angular relation thereto.
3. Such marking may be dispensed with; instead, the direction of the projected c axis may be determined as by the x-ray diffraction analysis of the storage substrate for the proper orientation of the collector electrode or electrodes thereon.
4. Not only one or two but also three or more collector electrodes may be provided on the storage substrate in accordance with the teachings of the invention.
5. The collector electrode need not be in the form of parallel stripes but may, for instance, be latticed, provided that the lattice has an appreciable degree of directionality.
6. The collector electrode or electrodes can be of metals other than chromium, examples being aluminum, nickel, molybdenum, and gold.
7. A backing electrode could be provided on the back of the storage target of FIGS. 1 and 2 and that of FIG. 9 as well.
8. The stripes of the collector electrode or electrodes need not extend in the direction of horizontal scanning but may extend at right angles therewith.

All these and other modifications within the usual knowledge of the specialists are considered to fall within the broad teaching hereof.

What is claimed is:

1. A storage target for a scan converter or other type of storage tube, comprising a storage substrate fabricated from a single crystal of sapphire, and a collector electrode having a directional pattern and formed on the storage substrate, the directionally patterned collector electrode being oriented at an angle ranging from about −45 degrees to about +45 degrees with respect to the projection of the c axis of the single sapphire crystal on the surface of the storage substrate bearing the collector electrode thereon.

2. The storage target of claim 1 wherein the angle of orientation of the directionally patterned collector electrode with respect to the projected c axis is approximately zero.

3. The storage target of claim 1 wherein the collector electrode has a plurality of stripes extending in parallel spaced relation to each other and in the above specified range of angles with respect to the projected c axis.

4. The storage target of claim 1 wherein the surface of the storage substrate bearing the collector electrode thereon is an r-plane of the single crystal of sapphire.

5. The storage target of claim 1 further comprising a second collector electrode also formed on the same surface of the storage substrate as the first recited collector electrode, the first and second collector electrodes being electrically separated from each other for the application of different voltages.

6. The storage target of claim 5 wherein the first and second collector electrodes include respective groups of parallel spaced stripes which are in staggered arrangement and which extend in the above specified range of angles with respect to the projected c axis.

7. A storage tube comprising an evacuated envelope, a storage target adjacent one end of the envelope, means adjacent another end of the envelope for emitting an electron beam directed toward the storage target, and means for deflecting the electron beam, the storage target having a storage substrate in the form of a single crystal of sapphire and a collector electrode on a storage surface of the storage substrate, the collector electrode having a directional pattern oriented at an angle ranging from about −45 degrees to about +45 degrees with respect to the projection of the c axis of the single crystal of sapphire on the storage surface of the storage substrate.

8. A direct view storage tube comprising an evacuated envelope having a screen at one end, a storage target behind the screen, means within the envelope for emitting an electron beam directed toward the storage target, and means for deflecting the electron beam, the storage target comprising a storage substrate in the form of a single crystal of sapphire having two group of parallel spaced grooves formed in its opposite surfaces in right angular relation to each other, there being an array of openings defined through the storage substrate at the intersections of the two groups of grooves, a backing electrode on that surface of the storage substrate which is directed toward the screen, and a collector electrode having a plurality of stripes overlying lands between the group of grooves in the other surface of the storage substrate, the stripes of the collector electrode extending at an angle ranging from about −45 degrees to about +45 degrees with respect to the projection of the c axis of the single sapphire crystal on the surface of the storage substrate.

9. A method of fabricating a storage target for a scan converter or other type of storage tube, which comprises providing a storage substrate in the form of a single crystal of sapphire, the storage substrate having a storage surface, marking the storage substrate to indicate the direction of the projection of the c axis of the single sapphire crystal on the storage surface of the storage substrate, producing a directionally patterned collector electrode on the storage surface of the storage substrate with the directional pattern oriented at an angle ranging from about −45 degrees to about +45 degrees with respect to the direction of the projected c axis as indicated by the marking.

* * * * *